US005255623A

United States Patent [19]

Sato et al.

[11] Patent Number: 5,255,623

[45] Date of Patent: Oct. 26, 1993

[54] WIPER FOR A SEWING MACHINE

[75] Inventors: Shuichi Sato; Shirou Ayusawa, both of Tochigi, Japan

[73] Assignee: The Singer Company N.V., Curacao, Netherlands Antilles

[21] Appl. No.: 881,113

[22] Filed: May 11, 1992

[30] Foreign Application Priority Data

Aug. 23, 1991 [JP] Japan ..... 3-074264[U]

[51] Int. Cl.[5] ..... D05B 65/06

[52] U.S. Cl. ..... 112/286

[58] Field of Search ..... 112/224, 225, 253, 278, 112/285, 286, 287, 291, 293, 302, DIG. 1

[56] References Cited

U.S. PATENT DOCUMENTS

| | | | |
|---|---|---|---|
| 3,584,589 | 6/1971 | Pirrello | 112/295 |
| 3,901,171 | 8/1975 | Rosa | 112/286 |
| 3,994,249 | 11/1976 | Hsiao | 112/285 |
| 4,352,333 | 10/1982 | Yamazawa | 112/295 X |
| 4,401,045 | 8/1983 | Russell | 112/286 |
| 4,422,397 | 12/1983 | Papajewski et al. | 112/286 |
| 4,436,044 | 3/1984 | Nordstrom et al. | 112/286 |
| 5,025,738 | 6/1991 | Sato et al. | 112/253 X |
| 5,044,290 | 9/1991 | Sato et al. | 112/286 |

FOREIGN PATENT DOCUMENTS

| | | | |
|---|---|---|---|
| 52-21930 | 6/1977 | Japan | 112/286 |

*Primary Examiner*—Clifford D. Crowder
*Assistant Examiner*—Ismael Izaguirre

[57] ABSTRACT

A wiper for a sewing machine wherein a hook portion formed at the tip end portion thereof comprises an inclined guide portion for contacting an upper thread in the forward stroke of a wiping operation of the wiper so as to guide the upper thread toward the tip end thereof. The wiper has an inclined introduction portion for guiding the upper thread, and has a thread hooking guide portion formed inside the inclined guide portion, for hooking the upper thread.

1 Claim, 3 Drawing Sheets

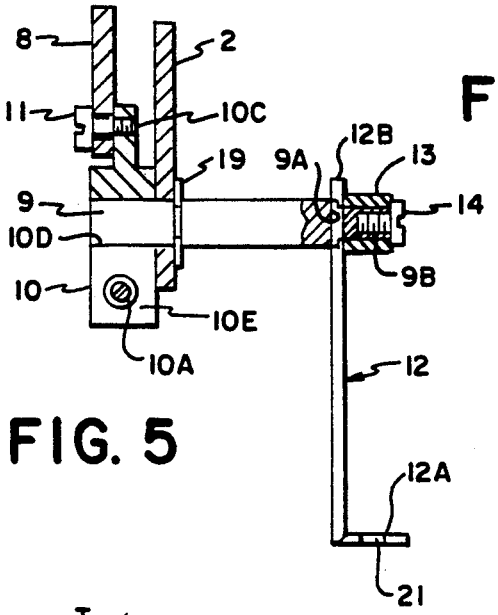
FIG. 5
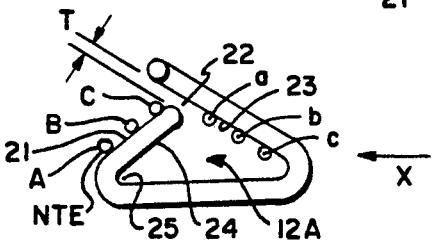
FIG. 6
FIG. 1
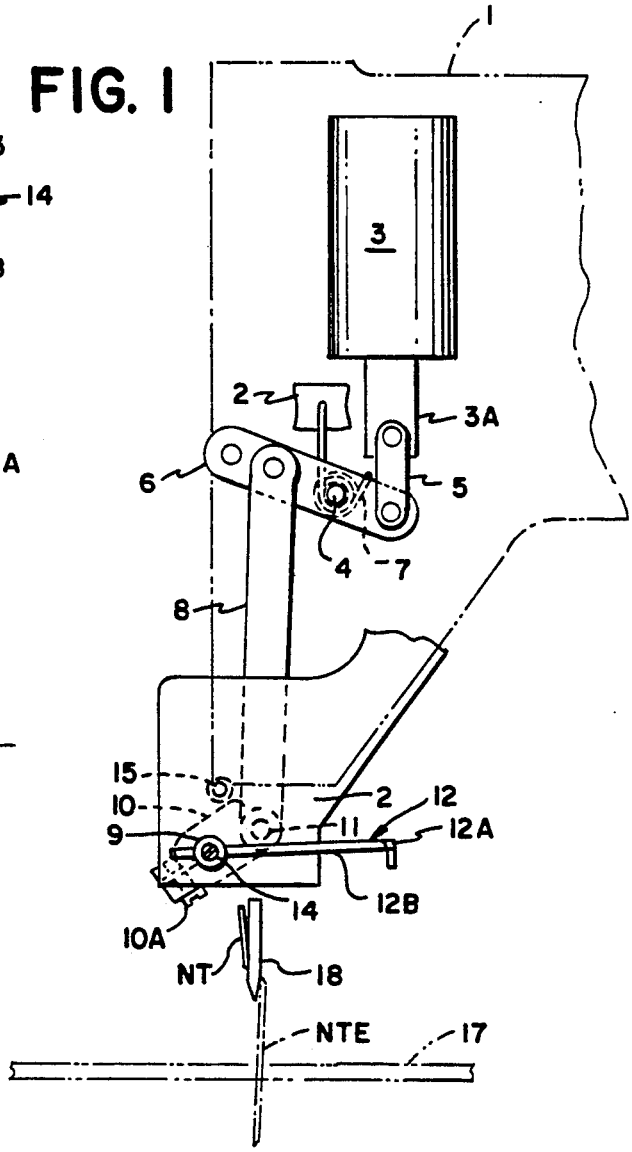
FIG. 9
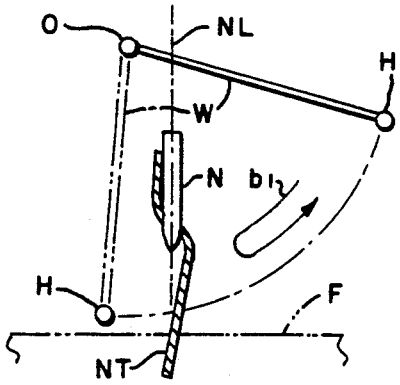
FIG. 10
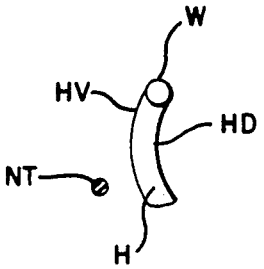

WIPER FOR A SEWING MACHINE

BACKGROUND OF THE INVENTION

1. Field of the Invention

The present invention relates to a wiper for a sewing machine.

2. Description of the Related Art

A wiper for a sewing machine is used to sweep a cut upper thread and pull it out to the upper side of a working cloth and a cloth presser after the working cloth has been completely sewn and the sewing thread has been cut thereunder. The wiper prevents the starting portion of the thread sewn into the succeeding working cloth from becoming slack on the upper side thereof and causing the quality of the working cloth to deteriorate.

Conventional wipers for a sewing machine utilize either one of two methods, i.e., either a forward stroke or a backward stroke wiping method. In the forward stroke method as shown in FIG. 8 the wiper W follows the trace as shown in an arrow a1 and performs a wiping operation when the wiper W proceeds to the rising position from a lowest rest position as shown by a solid line. In the backward stroke wiping method, as shown in FIG. 9 the wiper W follows the trace as shown in an arrow b1 and performs the wiping operation when the wiper W, which is at the highest rest position as shown by a solid line, proceeds to the rising position after lowering. In FIGS. 8 and 9, a hook portion H is formed at the tip end of the wiper W, O is a wiper shaft, F is a surface on which the working cloth is placed, NL is a vertical path of a needle N and NT is an upper thread which is drawn through the working cloth from the needle N.

A hook portion H of a conventional wiper W is shown in FIG. 10, wherein the wiping operation is performed at the concave circular arced surface HD in either of the forward and backward stroke methods.

An operator of the sewing machine employs either of the methods integrally, taking into consideration the specification and condition of sewing the working cloth.

When the forward stroke method is used and the rest position of the wiper W is close to the working cloth, the wiper W sometimes obstructs the sewing operation of some working cloths depending on the shapes and kinds thereof even though the wiper seldom fails to wipe the thread, since it wipes the upper thread NT which is drawn through the working cloth to the vertical path NL of the needle N at the concave circular arced surface HD of the hook portion H as it rises from the lowest rest position.

When the backward stroke method is used the hook portion H sometimes fails to catch the upper thread NT at the concave circular arced surface HD thereof during the backward stroke since the wiper W pushes off the upper thread NT during the lowering process of the forward stroke and thereafter pulls out the same from the working cloth as it rises or the hook portion H hooks the upper thread NT at the convex circular arched surface HV during the forward stroke and pulls out the thread from the working cloth so that it is extended toward the direction contrary to the cloth edge.

If the cut thread is wiped toward the opposite side of the cloth end, the end of the upper thread NT may be sewn into the working cloth as shown in FIG. 7, so that the quality of product deteriorates. Therefore the wiper W generally wipes the thread toward the cloth end in sewing operations.

SUMMARY OF THE INVENTION

In order to overcome the disadvantages of the two known methods described above, the present invention provides a wiper for a sewing machine for wiping out an upper thread wherein the wiper is fixed on an arm of a sewing machine and has a hook portion formed at the tip end portion thereof. The hook portion further comprises an inclined guide portion formed on the outside surface thereof for contacting the upper thread during a forward stroke of a wiping operation of the wiper from a rest position to a thread catching position, so as to guide the upper thread to the tip end portion of the inclined guide portion. An inclined introduction portion formed on an inside surface of the hook portion which forms a gap between the tip end portion of the inclined guide portion and the introduction portion for passing the upper thread therethrough and guiding the same toward a base end side of the inclined introduction portion. A thread hooking guide portion is formed on the inside surface of the inclined guide portion for hooking the upper thread guided by the inclined introduction portion in a return stroke of the wiping operation of the wiper. The thread hooking guide portion can be inclined so as to guide the hooked upper thread toward the base end side and the thread hooking guide portion can comprise a thread hooking recess formed at a corner on the base end side of the thread hooking guide portion.

As understood by the explanation set forth above, the rest position of the wiper according to the present invention is not so close to the working cloth as it is according to the conventional forward stroke wiping method so that the wiper does not obstruct the sewing operation since it catches the upper thread in the forward stroke and wipes out the same in the return stroke of the wiping operation. Hence the wiping failure is eliminated which could otherwise occur in the conventional backward stroke wiping method wherein the convex circular arced surface of the hook portion wipes away the upper thread extending between the needle and the working cloth as the wiper swings downward from the upper rest position.

The wiper according to the present invention can be manufactured with ease since it is simple in structure, and furthermore is very effective in practical use since by substituting the wiper of the present invention for the wiper of the conventional sewing machine employing a forward stroke wiping method wiping failure is effectively eliminated.

BRIEF DESCRIPTION OF THE DRAWINGS

FIG. 1 is a front view showing a main portion of a sewing machine equipped with a wiper according to a preferred embodiment of the present invention.

FIG. 5 is a partially cutaway side view showing the wiper mounted on an arm of the sewing machine.

FIG. 6 is a plan view of the wiper.

FIG. 9 is a view showing a conventional backward stroke thread wiping method.

FIG. 10 is a plan view of a conventional wiper.

PREFERRED EMBODIMENT OF THE INVENTION

Figure 2:
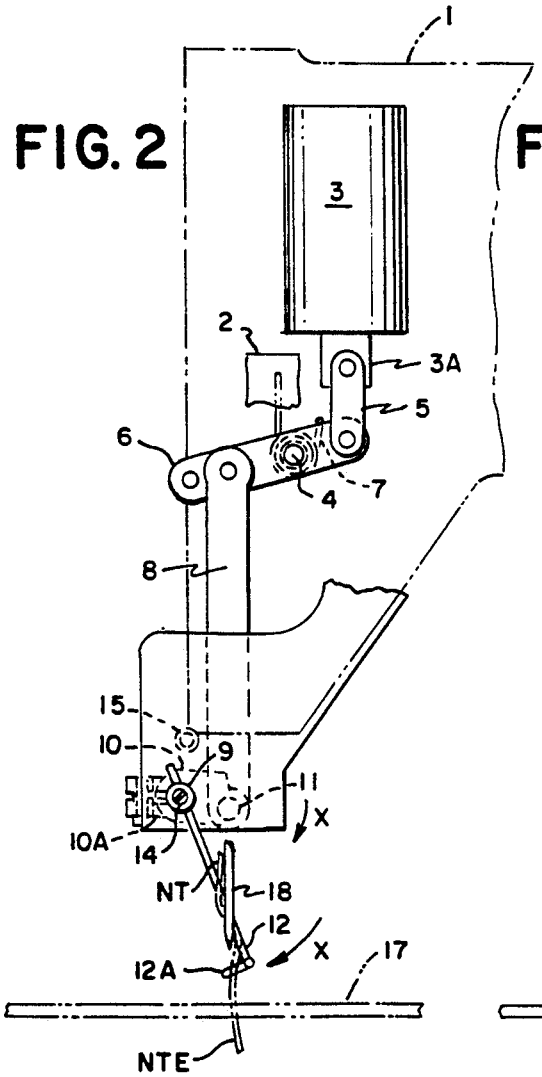
FIG. 2 is a view for explaining the operation of the wiper in a first position in FIG. 1.

A wiper for a sewing machine according to a preferred embodiment of the present invention will be described hereinafter.

FIGS. 1 to 6 shown an embodiment of the present invention. In FIG. 1, denoted 1 is a sewing machine arm. An electromagnetic solenoid 3 which is a driving means working or not according to the electric signal from a control system (not shown) is fixed to a supporting member 2 fixedly mounted on the rear surface of the jaws of the sewing machine arm 1. A plunger 2A of the electromagnetic solenoid 3 is swingably connected to one end of the swingable link 6 by way of a connecting link 5 by pins at the tip end thereof. The swingable link 6 is supported by the supporting member 2 at the central portion thereof so as to be turned about a shaft 4.

The swingable link 6 is used to magnify the displacement of the connecting link 5 and to transmit the thus magnified displacement to an operation link 8 which will be described later. Link 6 is always biased by a spiral spring 7 which is wound around the shaft 4 at the central portion thereof. Spring 7 is connected at one end to one end of the swingable link 6 and is connected at its other end to the supporting member 2 at the other end so that the plunger 3A may be at the prolonged rest position.

Figure 3:
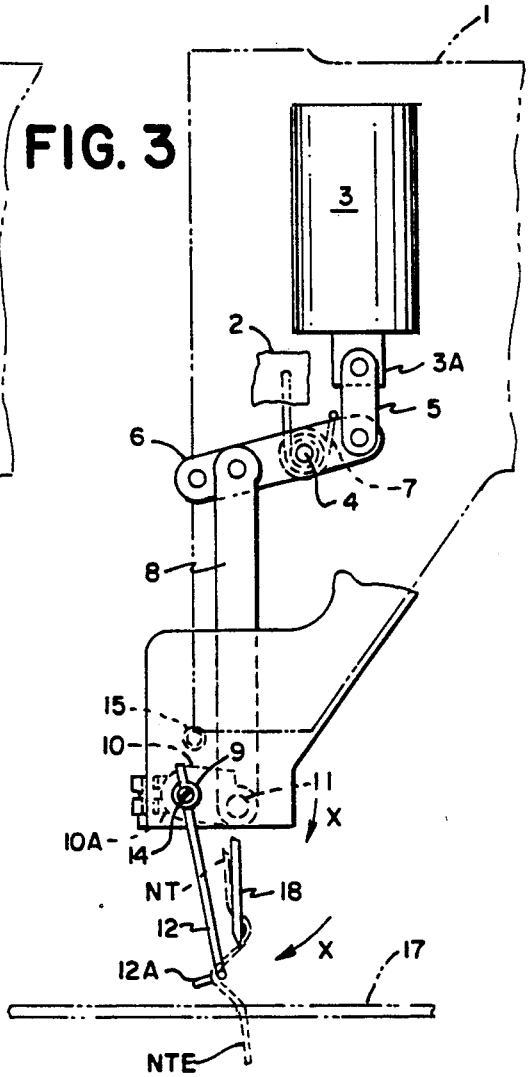
FIG. 3 is a view for explaining the operation of the wiper in a second position in FIG. 1.

The other end of the swingable link 6 is connected to one end of the operation link 8 by a pin, while the other end of the vertically extending operation link 8 is connected to the tip end portion of the wiper operation crank 10 by a pin, a hinge screw 11 is inserted into the bore 10*c* of the pin at the tip end portion of the wiper operation crank 10 as shown in FIG. 3.

The wiper operation crank 10 is disposed so as to extend inclinedly upward in FIG. 1. At the tip end portion crank 10 has a bore 10D at the base portion thereof in which a wiper shaft 9, which is rotatably supported about its axis by the supporting member 2, is inserted and is fixed to the wiper operation crank 10 by friction by clamping the divided portions 10E at the base portion thereof with a bolt 10A. Denoted at 19 is a C ring for preventing the wiper shaft 9 from dropping out of the through hole 10D. The wiper operation crank 10 can be fixed at an arbitrary position after loosening the bolt 10A and turning the wiper operation crank 10 relative to the wiper shaft 9.

In the original rest position as shown in FIG. 1 wherein the operation link 8 is substantially vertically lowered, the wiper operation crank 10 is driven to turn clockwise about the axis of the wiper shaft 9.

On the wiper shaft 9 is fixedly mounted a wiper 12. The wiper 12 is substantially L-shaped and comprises an arm portion 12B fixedly mounted on the wiper shaft 9 at the base portion thereof and a hook portion 12A connected to the tip portion of the arm portion 12B to form a hook for catching the thread end NTE of the upper thread NT. The hook portion 12A comprises an inclined guide portion 21, an inclined introduction portion 23, a thread hooking guide portion 24 and a thread hooking recess 25 as shown in FIG. 6.

The inclined guide portion 21 is formed on the outer side surface of the tip portion of the hook portion 12A and first contacts the upper thread NT in the forward stroke of wiping out operation wherein the wiper 12 starts lowering from its rest position so to initiate the thread catching operation. The inclined guide portion 21 is bent so that the wiper 12 may guide the contacting upper thread NT toward the tip end portion 22 in the course of lowering to the maximum swingable position and the inclined guide portion 21 is gradually inclined toward the direction contrary to the swinging direction X of the wiper 12 as shown in FIG. 6.

The inclined introduction portion 23 is formed on the inner surface of a side of the base portion of the hook portion 12A, and is opposed to the tip end portion 22 of the inclined guide portion 21 at substantially right angles thereto at a gap T for passing the upper thread NT therethrough. The inclined introduction portion 23 guides the upper thread NT which has passed through the gap T toward the base of the inclined guide portion 21.

The thread hooking guide portion 24 is formed on the inner side of the tip portion of the hook portion 12A and positioned inside the inclined guide portion 21, at the base side corner of which is formed a thread hooking recess 25 on the opposite side of the inclined introduction portion 23. The thread hooking guide portion 24 is gradually inclined toward the end thereof in the direction contrary to the swinging direction X of the wiper 12 so as to hook the upper thread NT guided by the inclined introduction portion 23 in the backward stroke of the wiper 12 and at the same time guides the upper thread NT to the base portion of the thread hooking guide portion 24. The upper thread NT guided by the thread hooking guide portion 24 is hooked by the thread hooking recess 25.

The wiper shaft 9 has a tip small diameter portion 9B. The base portion of the arm portion 12B of the wiper 12 equipped with such a hook portion 12A is inserted into a hole 9A provided in the tip portion 9B at the base side thereof. The base portion of the arm portion 12B of the wiper 12 is detachably fixed to the annular plane at the base of the tip small diameter portion 9B by pressing the same thereagainst by way of a spacer 13 by screwing a screw 14 into a threaded hole at the tip end of the tip small diameter portion 9B of the wiper shaft 9.

An operation of the wiper for a sewing machine according to the embodiment set forth above will be described hereinafter.

Just before the wiping operation of the wiper of the sewing machine as shown in FIG. 1, the wiper 12 is in a substantially horizontal standby state at its rest position where the hook portion 12A is at its uppermost position. At this position, an electric signal is fed to the electromagnetic solenoid 3 to draw back the plunger 3A against the resilience of the spring 7, when the swingable link 6 is turned on the shaft 4 by way of the connecting link 5 as shown in FIG. 2 so as to press down the operation link 8 and turn the wiper operating crank 10 together with the wiper shaft 9 in the direction of the arrow X, so that the wiper 12 integrated with the wiper shaft 9 is turned in the direction of the arrow X and proceeds to the thread catching position.

When the hook portion 12A of the wiper 12 passes under the needle 18 which is at the uppermost position thereof in the forward stroke of the wiper 12 for wiping out the upper thread, the thread end NTE of the upper thread NT first contacts the point A on the inclined guide portion 21 of the hook portion 12A as shown in FIG. 6. Accompanying the turning of the wiper 12, the upper thread NT moves along the inclined guide portion 21 toward the tip end portion 22 thereof in the order of A, B and C, and passes through the gap T formed between the tip portion 22 of the inclined guide portion 21 and the inclined introduction portion 23 before the completion of the forward stroke so as to be introduced and caught inside the hook portion 12A and then moves along the inclined introduction portion 23 in the order of a, b and c until the wiper 12 reaches its maximum swingable position.

FIG. 3 shown a position of the wiper 12 wherein the plunger 3A is most drawn back by an electromagnetic function of the electromagnetic solenoid 3, the wiper 12 reaches its extremity of swinging and the upper thread NT is completely caught inside the hook portion 12A.

Figure 4:
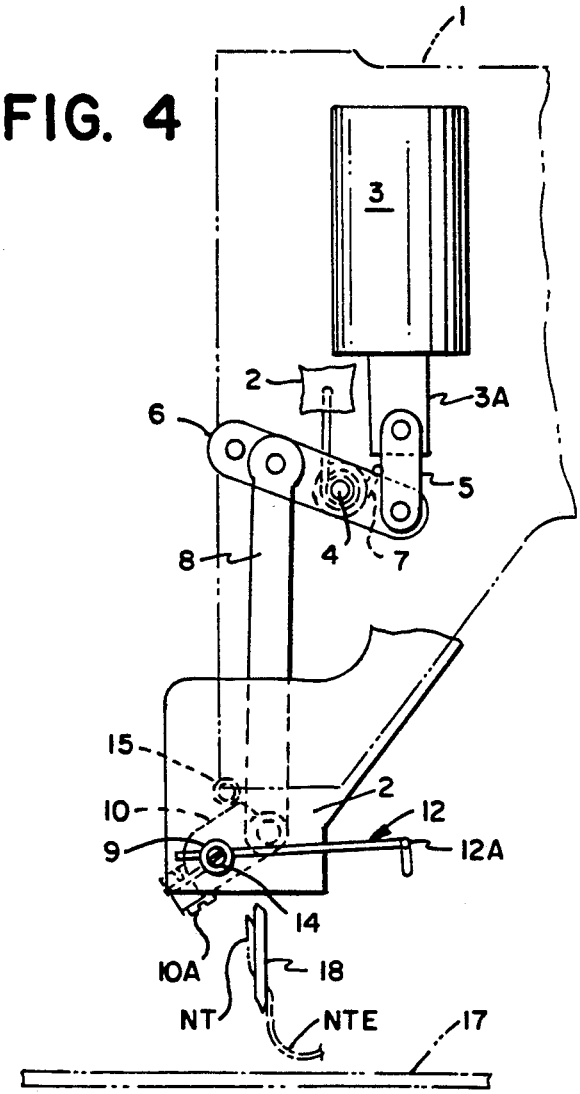
FIG. 4 is a view for explaining the operation of the wiper in a third position in FIG. 1.
Figure 7:
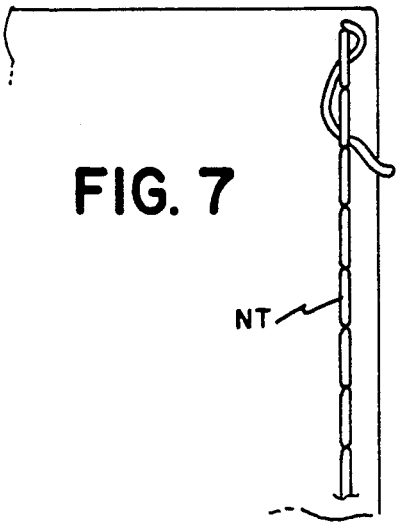
FIG. 7 is a view showing a position wherein the thread end of the upper thread is sewn into the working cloth.
Figure 8:
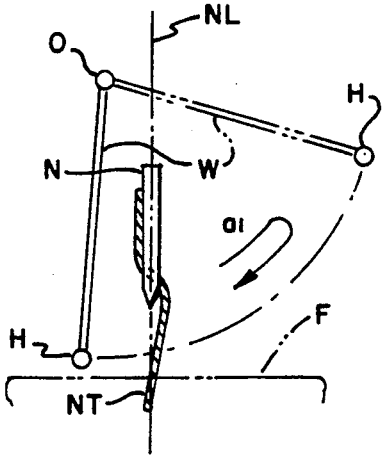
FIG. 8 is a view showing a conventional forward stroke thread wiping method.

When the plunger 3A of the electromagnetic solenoid 3 is returned to its original position, a backward stroke to the rest position of the wiper 12 is started. The upper thread NT is relatively displaced to the side of the thread hooking guide portion 24 from the side of the inclined introduction portion 23 and is hooked in the thread hooking recess 25 guided by the thread hooking guide portion 24 so as to be pulled from the working cloth and the wiping is completed. FIG. 4 shows the completed wiping operation, wherein the wiper 12 is in rest position and the upper thread NT is wiper away toward the cloth end.

Although the hook portion 12A of the wiper 12 is formed by bending a wire in the above embodiment, it is also possible to form the same by blanking a metal plate.

The following effects can be obtained according to the present invention.

The wiper 12 is at its rest position before starting the thread wiping operation where its hook portion is at its upper most position. The wiper 12 proceeds to a thread catching process from this position.

The upper thread NT contacts the inclined guide portion 24 of the hook portion 12A when the upper thread NT passes under the needle 18 which is at the uppermost position thereof in the forward stroke of thread wiping operation. As the wiper 12 moves on, the upper thread NT moves along the inclined guide portion 24 toward the tip end portion thereof, passes the gap formed between the tip end portion of the inclined guide portion 24 and the inclined introduction portion 23 before the end of the forward stroke so as to be introduced inside the hook portion and then moves on along the inclined introduction portion 23 until the wiper 12 reaches its maximum swingable position. In this way the upper thread NT is completely caught inside the hook portion in the forward stroke of the thread wiping operation.

Upon completion of the forward stroke of the wiping operation when the wiper 12 reaches its maximum swingable position, the return stroke of the wiping operation is initiated, and the upper thread NT moves relatively to the thread hooking guide portion 24 from the side of the inclined introduction portion, is hooked in the thread hooking guide portion 24 and is pulled from the working cloth to complete the thread wiping operation. Thereafter, the wiper 12 is returned to its home position.

Inasmuch as the thread hooking guide portion 24 is inclined so as to guide the hooked upper thread toward the base side thereof and comprises the thread hooking recess 25 formed at the corner on the base side thereof, the upper thread hooked by the thread hook guide portion 24 is guided toward the base side thereof so as to be hooked by the thread hooking recess 25 and is pulled from the working cloth, so that the thread wiping operation is completed.

What is claimed is:

1. A wiper for wiping an upper thread and fixed on an arm of a sewing machine, said wiper comprising:

an L shaped component having a long leg and a hook disposed at right angles to the long leg;

said hook consisting of first, second and third straight elongated members, one end of the first member being integral with one end of the long leg, the other end of the first member being connected to one end of the second member by an integral first inwardly curved corner, the other end of the second member being connected to one end of the third member by an integral second inwardly curved corner, the other end of the third member pointing toward the first member but spaced therefrom to form a gap therebetween, the third member being disposed at substantially right angles to the first member;

the outside surface of the third member defining an inclined portion for contacting the upper thread during a forward stroke of a wiping operation of the wiper from a rest position to a thread catching position so as to guide the upper thread to the other end of the third member;

the inside surface of the first member and the second member defining an inclined introduction portion for passing the upper thread through said gap and guiding the upper thread toward said second inner curved corner; and the inner surface of the second corner defining a thread hooking recess for hooking the upper thread guided by the inclined introduction portion in a return stroke of the wiping operation of the wiper.

* * * * *